US008047291B2

(12) United States Patent
Lynde

(10) Patent No.: US 8,047,291 B2
(45) Date of Patent: Nov. 1, 2011

(54) TOOL AND METHOD FOR ABRASIVE FORMATION OF OPENINGS IN DOWNHOLE STRUCTURES

(75) Inventor: Gerald D. Lynde, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 254 days.

(21) Appl. No.: 12/424,301

(22) Filed: Apr. 15, 2009

(65) Prior Publication Data

US 2010/0263868 A1 Oct. 21, 2010

(51) Int. Cl.
*E21B 43/26* (2006.01)
*E21B 29/00* (2006.01)

(52) U.S. Cl. ..... 166/298; 166/177.5

(58) Field of Classification Search ..... 166/271, 166/307, 222, 311, 308.1, 298, 55, 55.1, 166/177.5; 175/424
See application file for complete search history.

(56) References Cited

U.S. PATENT DOCUMENTS 2,631,673 A * 3/1953 Halderson et al. ..... 166/307
4,197,910 A 4/1980 Hutchison
4,346,761 A 8/1982 Skinner et al.
4,478,368 A 10/1984 Yie
4,663,893 A 5/1987 Savanick et al.
5,361,856 A * 11/1994 Surjaatmadja et al. ..... 175/67
5,787,998 A 8/1998 O'Hanlon et al.
6,073,708 A 6/2000 Brown et al.
2003/0148709 A1 8/2003 Anand et al.
2007/0251687 A1 11/2007 Martinez et al.

FOREIGN PATENT DOCUMENTS

JP 07-024737 1/1995

OTHER PUBLICATIONS

International Search Report and Written Opinion; Mailed Nov. 19, 2010; International Appln No. PCT/US2010/031145; International Search Report 5 Pages; Written Opinion 3 Pages.
Adamson, Keelan, et al. "High-Pressure, High-Temperature Well Construction", Oilfield Review, Aberdeen, Scotland, UK, Summer 1998, pp. 36-49.

* cited by examiner

*Primary Examiner* — Kenneth L Thompson
(74) *Attorney, Agent, or Firm* — Cantor Colburn LLP

(57) ABSTRACT

An abrasive slurry tool, the tool being attachable to a running string, the tool including a high-pressure assembly, the assembly including a nozzle assembly; and a low-pressure assembly in abrasive fluid communication with the high-pressure assembly, the low-pressure assembly comprising a low pressure holding tank configured to carry recharge abrasive fluid with the tool and method.

17 Claims, 1 Drawing Sheet

TOOL AND METHOD FOR ABRASIVE FORMATION OF OPENINGS IN DOWNHOLE STRUCTURES

BACKGROUND

In the hydrocarbon industry, many different types of tools are introduced to the downhole environment for a variety of different purposes. Some of these tools are meant to be further modified in the downhole environment at selected times relative to other installations or for independent reasons. For example, production tubes are often used in the downhole environment and are post-installation modified by creating openings therein vernacularly termed "windows" that are used to allow access to other downhole structures such as lateral boreholes. Commonly, such windows are milled in the casing or production tubing using standard milling equipment. While this method has been used for years and certainly results in the creation of an opening, that opening is often of inconsistent shape and is often quite rough at the edge. This makes it difficult to seal a junction, for example, therein as both the shapes of the opening and the roughness are not accurately known.

The art has attempted to use abrasive slurries to cut openings in the downhole environment but has not met with great success due to the settling of abrasive material, wear on machinery, very high operating pressure, etc. With increasing use of multilateral wellbore systems and other constructions using openings that require, or at least are benefited by, sealing or baffling thereat, the art is always receptive to new apparatus and methods for improving openings such as windows.

SUMMARY

An abrasive slurry tool, the tool being attachable to a running string, the tool including a high-pressure assembly, the assembly including a nozzle assembly; and a low-pressure assembly in abrasive fluid communication with the high-pressure assembly, the low-pressure assembly comprising a low pressure holding tank configured to carry recharge abrasive fluid with the tool.

A method for creating an opening in a downhole structure including running into a borehole on a string, a tool having a high pressure assembly, the assembly including a nozzle assembly and a low pressure assembly in abrasive fluid communication with the high pressure assembly, the low pressure assembly comprising a low pressure holding tank configured to carry recharge abrasive fluid with the tool; positioning the tool as a target location; actuating the tool to emit high pressure abrasive fluid at the target structure; and abrasively affecting the target structure.

BRIEF DESCRIPTION OF THE DRAWING

Referring now to the drawing wherein like elements are numbered alike in the FIGURE.

The FIGURE is a schematic view of an abrasive slurry tool as disclosed herein.

Figure 1:
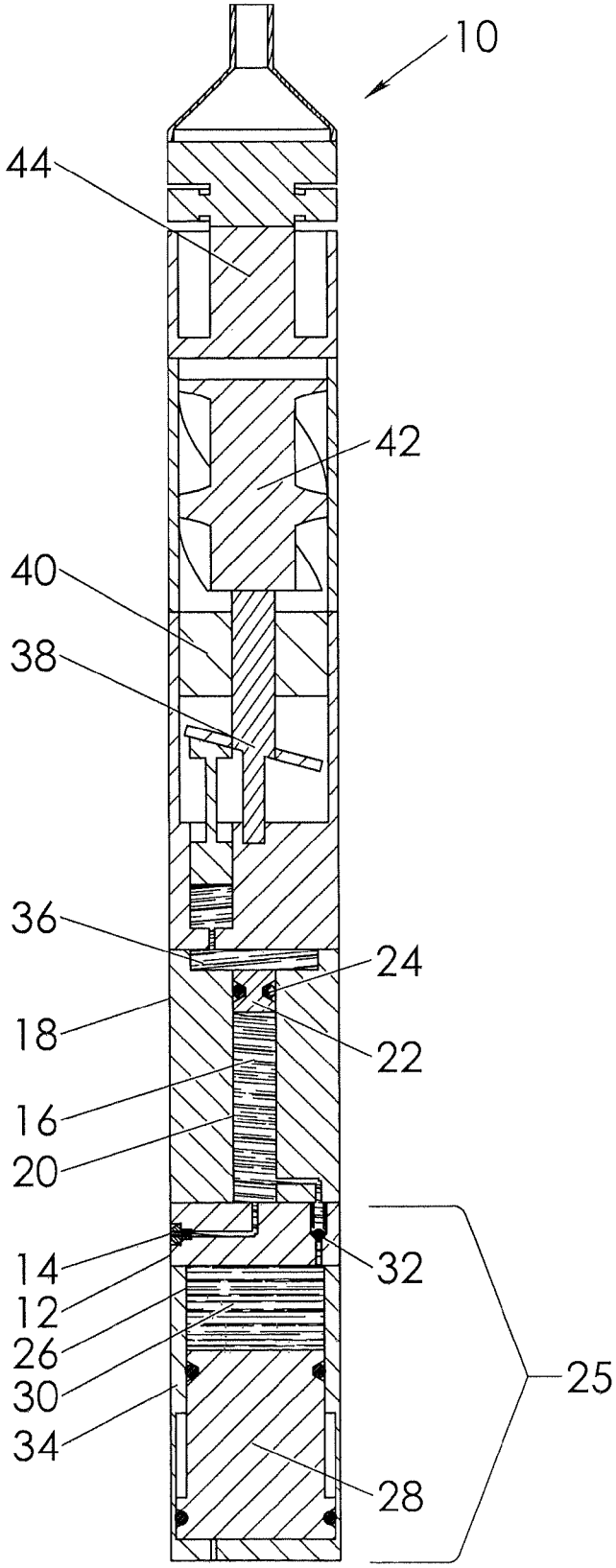
Referring to FIG. 1, an abrasive slurry tool 10 is schematically illustrated. The tool includes nozzle assembly 12 having one or more individual nozzles 14 that is fed a cutting slurry 16 at high pressure from a high-pressure assembly 18. The slurry, under high pressure, is directed by the nozzle assembly 12 toward a target structure to be cut. In one embodiment the nozzle assembly 12 positions the one or more individual nozzles 14 in close proximity to the target structure to maximize the cutting effect of the high-pressure cutting fluid 16. It is to be noted that the nozzle assembly is adjustable to select direction of fluid emission from the individual nozzles and to adjust proximity to a target structure to be cut. The cutting fluid 16 is contained within a piston cylinder 20 within which a piston 22 is translatable. The piston 22 is sealed to the cylinder 20 by a suitable seal structure 24, which in one embodiment may be an O-ring. Pressure is imparted to the fluid 16 by the movement of the piston 22 into the cylinder 20 thereby reducing the physical volume of the cylinder 20 within which the fluid 16 is disposed. This high-pressure fluid may then be released to the nozzle assembly 12 and directed to the target structure as noted.

It may be appreciated by one of skill in the art that the cylinder 20 is relatively small. This in fact is one of the benefits of the device disclosed herein, as it means that the device need not be unwieldy in length and need not require a high horsepower pump to produce the PSI desired in the cutting fluid exiting nozzle assembly 12 during a cutting operation. Rather, sufficient cutting fluid is supplied to the task at hand by cycling the high-pressure assembly 18 through periods where fluid is expressed therefrom at high pressure and periods where fluid is drawn into the cylinder 20 from a low-pressure assembly 25 having a low pressure holding tank 26 and a recharge piston 28. Since the holding tank 26 need not be at high pressure, the diameter thereof can be larger and thereby the tank is capable of holding more cutting fluid while still allowing the recharge piston 28 to produce sufficient pressure in the recharge fluid 30 to flow into the cylinder 20. To be noted is that all of the fluid necessary for a given cutting operation is carried along with the tool and therefore need not be supplied from surface. This avoids all of the inherent problems of surface based supply such as the requirement of very high horsepower pumps and special fluids that will maintain the abrasive in suspension for a long standby period and a long run of changing conditions as the fluid moves downhole to the target location. In one embodiment, the disclosure herein utilizes a thixotropic fluid such as Kelzan tm fluid to have sufficient suspension characteristics for the configuration of the tool 10 while also remaining easily pumpable.

It will be noted that a check valve 32 is employed in one embodiment to allow fluid flow from holding tank 26 into cylinder 20 but not from cylinder 20 into holding tank 26. Were the check valve not used, the same result could be obtained by configuring the recharge piston to move in only one direction such as by incorporating a ratchet thread operable between the piston and a recharge housing 34.

Pressurization of the fluid 16 is effected through the piston 22 based upon clean hydraulic fluid 36, in one embodiment, pressurized against the piston 22. The hydraulic fluid is maintained in a clean condition, by relying on the piston 22 to separate the fluid volumes, to reduce wear on a pump 38 that is used in conjunction therewith. In one embodiment the pump is a wobble plate type pump while in other embodiments, other types of pumps such as positive displacement pumps, etc. could be used. In one embodiment the pump is capable of producing 60,000 psi in the fluid pumped.

In one embodiment the pump is run by a motor 42, which may be a mud motor, an electric motor, etc. In operable communication with the pump 38 is a hydraulic fluid container 40. The container 40 provides both fluid to move the piston 22 and accepts fluid volume during the recharge phase of the tool.

In one embodiment of the tool 10, the anchor and positioner 44 (shown at an uphole end of the tool 10 but could be at other locations relative to the tool) is actuable to anchor the tool to a tubular in which the tool 10 is and then to direct the movement of the tool to cause the nozzle assembly to follow a path that will produce the opening configuration selected. It is to be understood that although the schematic drawing of FIG. 1 suggests that the anchor and positioner are a single component, this is not required. Rather they may be separate components adjacent one another substantially as is already shown or even spaced from one another. In one embodiment the opening configuration is an oval for a standard exit window however, there is no restriction to this configuration. Rather any configuration is possible with the tool 10 disclosed herein due to the nature of cutting of the high-pressure abrasive fluid cutting as will be appreciated by those of skill in the art. As one of ordinary skill in the art is well aware, positioning devices are found in this and other industries that are well suited to use in connection with the abrasive fluid cutting device disclosed herein.

In operation, the tool 10 is run to depth on a suitable conveyor such as coil tubing or drillpipe and anchored. The positioning system is then actuated to locate the nozzle assembly as desired. The pump is actuated to express high-pressure cutting fluid 16 through the nozzle assembly 12 and against a target to be cut. Motion of the positioning system is set to move the nozzle assembly 12 at a selected rate that is related to the material to be cut. For example, for a target structure to be cut of steel having a one half inch thickness, the nozzle assembly may be moved at up to about 30 inches per minute for a cut normal to the surface of the target structure. Speeds may be adjusted for different thicknesses of similar material or for different material entirely depending upon their individual resistance to abrasive cutting. Once the opening is cut, the tool may be moved for other duty or withdrawn from the wellbore as desired.

It is to be appreciated that while the illustrated tool is of relatively consistent outside diameter along the length of the tool it is contemplated that the tool could be configured to allow the components necessary for cutting, such as the nozzle assembly to be made of smaller diameter to fit into a smaller tubing while the balance of the tool remains in a larger tubing. In addition, the nozzle assembly may be configured to have a longer nozzle to be closer to the target structure to be cut so that fluid velocity is not lost to distance.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. An abrasive slurry tool, the tool being attachable to a running string, the tool comprising:

a high-pressure assembly, the assembly including a nozzle assembly and a pump; and a low-pressure assembly in abrasive fluid communication with the high-pressure assembly, the low-pressure assembly comprising a low pressure holding tank configured to carry recharge abrasive fluid with the tool, the pump segregated from contact with the abrasive fluid.

2. The tool as claimed in claim 1 wherein the high-pressure assembly includes a cylinder and a piston translatable within the cylinder, the piston capable of transmitting pressure to an abrasive fluid in the cylinder.

3. The tool as claimed in claim 1 wherein abrasive fluid within the cylinder is expellable at high pressure through the nozzle assembly.

4. The tool as claimed in claim 3 wherein the nozzle assembly further comprises one or more nozzles.

5. The tool as claimed in claim 1 wherein the nozzle assembly is adjustable for direction of fluid emission and proximity to a target structure to be cut.

6. The tool as claimed in claim 1 wherein the low pressure assembly functions to recharge the high-pressure assembly with abrasive fluid during certain periods of operation of the high-pressure assembly.

7. The tool as claimed in claim 6 wherein the high pressure assembly includes a cylinder and a piston translatable within the cylinder, the piston capable of transmitting pressure to an abrasive fluid in the cylinder the certain periods of operation are those wherein the high pressure assembly piston is not transmitting pressure to the abrasive fluid.

8. The tool as claimed in claim 1 wherein the segregation is by a high-pressure assembly piston.

9. The tool as claimed in claim 1 wherein the pump is a wobble plate type pump.

10. The tool as claimed in claim 1 further comprising an anchoring and rotator component.

11. An abrasive slurry tool, the tool being attachable to a running string, the tool comprising:

a high-pressure assembly, the assembly including a nozzle assembly; and a low-pressure assembly in abrasive fluid communication with the high-pressure assembly, the low-pressure assembly comprising a low pressure holding tank configured to carry recharge abrasive fluid with the tool and a recharge piston in translatable communication with the holding tank to thereby urge abrasive fluid to the high-pressure assembly.

12. The tool as claimed in claim 1 wherein the pump is driven by a motor.

13. The tool as claimed in claim 12 wherein the motor is a mud motor.

14. The tool as claimed in claim 12 wherein the motor is an electric motor.

15. A method for creating an opening in a downhole structure comprising:

running into a borehole on a string, a tool having a high pressure assembly and a low pressure assembly, the high pressure assembly including a nozzle assembly and a pump, the low pressure assembly in abrasive fluid communication with the high pressure assembly, the low pressure assembly comprising a low pressure holding tank configured to carry recharge abrasive fluid with the tool, the pump segregated from contact with the abrasive fluid;

positioning the tool as a target location;

actuating the tool to emit high pressure abrasive fluid at the target structure; and abrasively affecting the target structure.

16. The method as claimed in claim 15 further comprising recharging an abrasive fluid supply in the high-pressure assembly from the low-pressure assembly.

17. The method as claimed in claim 16 wherein the recharging is carried out during periods when the high-pressure assembly is not producing high pressure.

* * * * *